US005631441A

United States Patent [19]

Brière et al.

[11] Patent Number: 5,631,441

[45] Date of Patent: May 20, 1997

[54] XDM PYROPHORIC COUNTERMEASURE FLARE

[75] Inventors: Paul Brière; Michel St-Onge; André Roy; Bruno Paradis; Louis Légaré, all of Québec, Canada

[73] Assignee: Her Majesty the Queen in right of Canada, as represented by the Minister of National Defence of Her Majesty's Canadian Government, Ottawa, Canada

[21] Appl. No.: 626,453

[22] Filed: Apr. 2, 1996

[51] Int. Cl.[6] ..... F42B 4/26

[52] U.S. Cl. ..... 102/336; 102/326; 102/328; 102/343; 102/370

[58] Field of Search ..... 102/336, 326–328, 102/343, 370

[56] References Cited

U.S. PATENT DOCUMENTS

| | | | |
|---|---|---|---|
| H1603 | 11/1996 | Deckard et al. . | |
| 2,963,975 | 12/1960 | Musser | 102/370 |
| 3,970,003 | 7/1976 | Hayward et al. | 102/336 |
| 5,313,888 | 5/1994 | Martin | 102/334 |
| 5,390,605 | 2/1995 | Meili et al. | 102/336 |
| 5,400,712 | 3/1995 | Herbage et al. | 102/331 |
| 5,419,257 | 5/1995 | Leichter et al. | 102/328 X |

FOREIGN PATENT DOCUMENTS 2078504 3/1993 Canada .

*Primary Examiner*—Peter A. Nelson
*Attorney, Agent, or Firm*—Larson and Taylor

[57] ABSTRACT

A decoy flare for infrared (IR) seeking missiles comprises a tubular outer shell with a first rupturing disc sealing a rear end of the outer shell and a cover member with a second rupturing disc sealing a front end of the outer shell. These form a sealed container for a pyrophoric liquid. A nozzle cap is attached to the cover member with a nozzle being located in front of the second rupturing disc. A piston in the container adjacent the first rupturing disc separates the pyrophoric liquid from the disc. A holder for a gas generator, a disc of energetic material, is connected in sealed relationship to the container to position the gas generator adjacent the first rupturing disc and form a gas generating chamber between the holder and that disc. That holder contains an ignition mechanism for the gas generator and a seal to prevent gases from escaping via the ignition mechanism after it is activated. Gases generated in the chamber will rupture the first rupturing disc, pushing the piston forward to rupture the second disc and eject pyrophoric liquid from the nozzle. A base portion connected to the flare forms a holder for an impulse cartridge that separates the flare from the base portion when activated, that separation activating the ignition mechanism. In these decoy flares, a friction wire safety ignition mechanism may be used to activate the gas generator upon separation of the flare from the base or, alternatively, a bore rider safety ignition mechanism may be used.

20 Claims, 6 Drawing Sheets

SECTION A-A

XDM PYROPHORIC COUNTERMEASURE FLARE

FIELD OF THE INVENTION

The present invention relates to decoy flares for infrared seeking missiles and in particular to a countermeasure flare containing a pyrophoric liquid which reacts and burn on exposure to air as the liquid is ejected from a flare's nozzle.

BACKGROUND OF THE INVENTION

First generation infrared (IR) guided missiles could possibly be avoided by pilot manoeuvres that consisted of pointing a targeted aircraft in the direction of the sun to blind the IR missile's detector system or by launching decoy flares onto which the missiles detector would lock and decoy the missile away from the aircraft. Current decoy flares are generally of the pyrotechnic type which produces radiation by combustion of solid pyrotechnic compositions. The most commonly used composition, named MTV composition, is composed of magnesium, teflon and Viton*. This MTV composition produces a very hot flame and provides an intense point source of IR radiation that should attract this first generation of IR guided missiles. However, advances in missile IR seekers have significantly reduced the effectiveness of currently fielded pyrotechnic flares. None of the known systems offers the required protection performance against these newer missiles.

* Trade Mark

The new generation of IR guided missiles are equipped with one or more electronic counter-countermeasures that can discriminate and reject aircraft protective countermeasures such as the current decoy flares. These new IR guided missiles have detection systems that can usually distinguish and analyze three bands in the spectral emissions of aircrafts. Therefore, any detected signal in which the band intensities and ratios do not conform to the target aircraft's spectral signature would be recognized as a countermeasure and ignored. Countermeasure flares would now have to produce a spectral signature similar to those of aircrafts in order to be effective. This is not the case with pyrotechnic flares. Pyrotechnic flare's spectral signature are, in fact, very different from that of an aircraft because they emit principally in the first spectral band that would be analyzed by newer guided missiles IR seeker whereas a jet aircraft's signature shows high intensities in the second and third bands. This spectral mismatched signature generally limits the usefulness of current pyrotechnic flares to the previous generation of IR guided missiles.

Operational analysis, based on measured experimental flare performance, show that pyrophoric flares offer a strong potential to provide the required performance to decoy the newer generation of IR seeking missiles. The spectral signature of a pyrophoric liquid, such as alkyl aluminum compounds that burn spontaneously when sprayed into the air, more closely resemble a jet aircraft's spectral signature so that an IR seeking missile would not recognize that type of flare as a countermeasure. Some attempts were made by others to develop effective flares using pyrophoric liquids during the 1980's but were unsuccessful.

The basic functioning principles of any pyrophoric flare would have very little in common to the existing pyrotechnic flare except for the fact that they are both ejected from a launcher by an impulse cartridge. A pyrophoric flare would require a liquid in a perfectly sealed reservoir since pyrophoric liquids react and burn on exposure to air using the oxygen of the air as an oxidant. Pyrotechnic flares, on the other hand, use a solid grain composition contained in a protective shell. Some means would be required in a pyrophoric flare to eject the pyrophoric liquid through a calibrated nozzle such as a gas generator to provide a certain pressure profile inside the flare to break rupturing discs and eject the liquid. Therefore, a high stress resistance container and special sealing component attachments would be required for a pyrophoric flare. These items are not required for a pyrotechnic flare. In addition, mobile and/or removable components of the ignition system for any pyrophoric flare would require special sealing devices to prevent any pressure leaks through the ignition system during the whole functioning of the flare. This is not a concern for a pyrotechnic flare. Furthermore, pyrophoric liquids, such as alkyl aluminum compounds, are incompatible with many materials and especially with most polymers. These constraints require a completely new flare design for pyrophoric flares which has not existed up to present.

SUMMARY OF THE INVENTION

It is an object of the present invention to provide a decoy flare for infrared (IR) seeking missiles wherein the IR spectral signature of the flare closely resembles that of an aircraft's spectral signature over several spectral bands.

A decoy flare for infrared (IR) seeking missiles according to the present invention comprises a tubular outer shell with a first rupturing disc adjacent to and closing a rear end of the outer shell and a cover member with a central second rupturing disc sealing another end of the outer shell, a nozzle cap with a nozzle being attached to the cover member adjacent an outer surface of the second rupturing disc, the nozzle being located in front of that outer surface, the outer shell and cover member forming a container for a pyrophoric liquid with a movable closure in the tubular outer shell being initially located adjacent the first rupturing disc between pyrophoric liquid in the container and the first rupturing disc; the flare having a first holder for a gas generating means with that holder being connected in sealed relationship to said container in a position to locate the gas generating means near an outer surface of the first rupturing disc and form a gas generating chamber between the first rupturing disc and said first holder, the first holder being provided with an initiating means to activate said gas generating means and a sealing means to prevent gases generated by the gas generating means from exiting via said first holder when the initiating means is activated; the flare having a base portion, a means for attaching the base portion to the tubular outer shell and to separate the base from the outer shell when the flare is activated, the base portion forming a further holder for a means to activate said initiating means. In one embodiment of the invention, the holder is provided with a friction wire safety ignition mechanism to initiate the gas generating means, the gas generating means being a disc of energetic materials. In a further embodiment of the invention, the holder is provided with a bore rider safety ignition mechanism to initiate the gas generating means, the gas generating means being a disc of energetic materials.

BRIEF DESCRIPTION OF THE DRAWINGS

The following detailed description of the invention will be more readily understood when considered in conjunction with the accompanying drawings, in which.

DESCRIPTION OF THE PREFERRED EMBODIMENTS

Figure 1A:
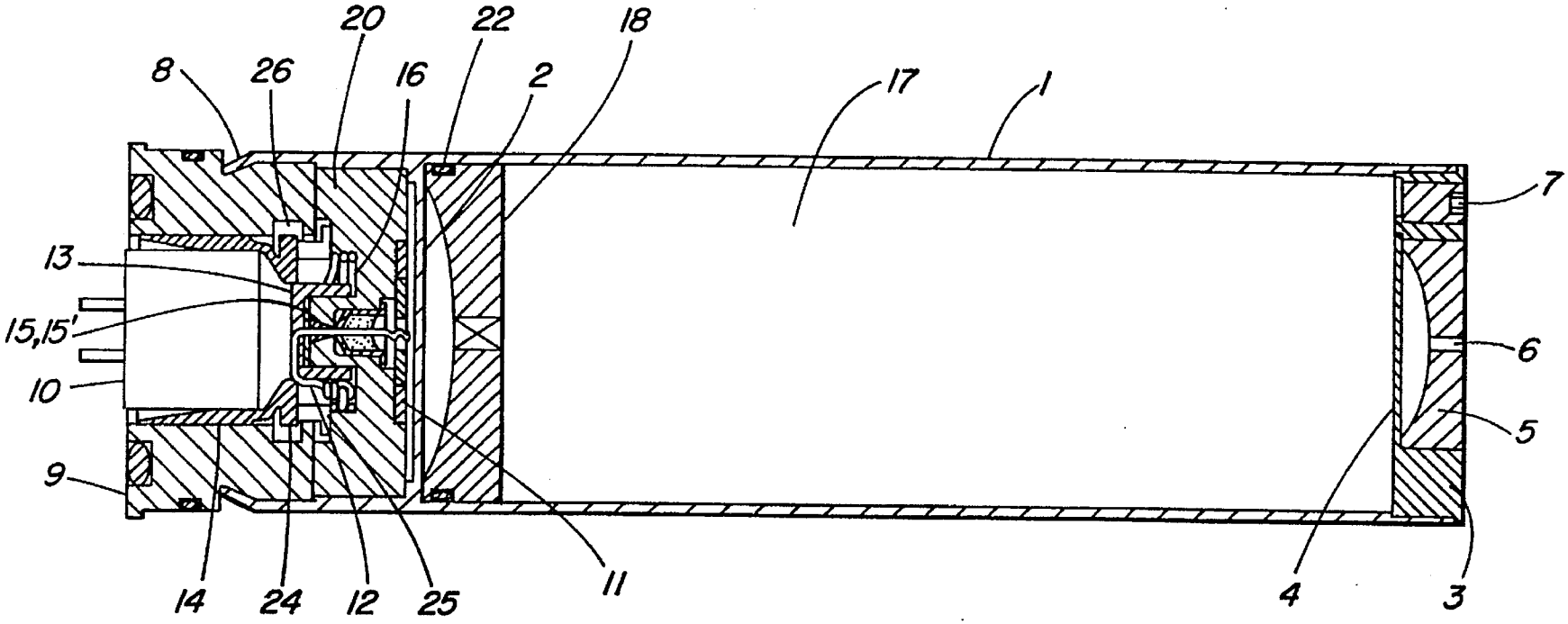
FIG. 1*a* is a cross-sectional view of a pyrophoric flare according to one embodiment of the invention with friction wire safety ignition mechanism.

FIG. 1*a* illustrates a friction wire activated pyrophoric flare according to a first embodiment of the invention. In this embodiment, the main body of the pyrophoric flare consists of an outer cylindrical tubular shell 1 with a rupturing disc 2 near the flare's base that are formed together as a single piece which is made by impact extrusion. This provides a perfect seal between rupturing disc 2 and outer shell 1 since no mechanical attachment is required. This arrangement fulfils an essential requirement for a perfectly sealed reservoir containing the pyrophoric liquid 17, the outer end of the tubular shell 1 being sealed with a cover assembly 3 containing a second rupturing disc 4. The cover 3 and rupturing disc 4 are formed as a single piece and sealed to the inner edge of the open end of tubular shell 1 by Loctite* coated threads or, alternatively, by welding. A nozzle cap 5 and filling plug 7 are mounted onto the cover 3. A piston 18 with O-ring 22 is located adjacent rupturing disc 2 inside the cylindrical shell 1.

* Trade Mark

The cover assembly 3 contains a central outer cylindrical recess in front of rupturing disc 4 with a nozzle cap 5 being fixed in that recess. That nozzle cap 5 includes a central calibrated nozzle 6 through which the pyrophoric liquid 17 can be ejected once rupturing disc 4 fails upon activation of the flare. The rupturing disc 4 isolates the nozzle cap 5 from the pyrophoric liquid until the flare is activated. Thus, this cover assembly 3 is free of any sealing gaskets or O-rings that might leak or react with the pyrophoric liquid. The cover assembly 3 also includes a filling plug 7 for an opening in the cover, located between the central recess and outer edge of cover 3, through which pyrophoric liquid 17 can be added to the interior of cylindrical shell 1. The filling plug 7 can be easily sealed into that opening by various methods including teflon tape on threads. The pyrophoric liquid may be one of the alkyl aluminum compounds that burns spontaneously when sprayed into the atmosphere.

The tubular shell 1 extends rearwardly of the first rupturing disc 2 with its outer edge being crimped at 8 into a notch that encircles the outer surface of cylindrical flare base 9. The outer surface of flare base 9 rests against an inner flange of shell 1 and against a holder 20 for the gas generator 11 and a friction wire ignition mechanism, which holder is positioned so that the gas generator 11 is adjacent the rupturing disc 2. The outer edge of holder 20 rests against a further inner flange of shell 1, the holder 20 being connected and sealed to shell 1. A preferred type of gas generator 11 is shown in more detail in FIG. 4. The gas generator 11, in this embodiment, comprises a thin disc of energetic materials that can be ignited by a suitable ignition mechanism to produce gases and raise the pressures in the flare. That thin disc 11 is fixed in position in a central recessed portion of holder 20 so that it is located near rupturing disc 2 which will rupture once pressure generated by the gas generator 11 reaches a predetermined value.

Figure 4:
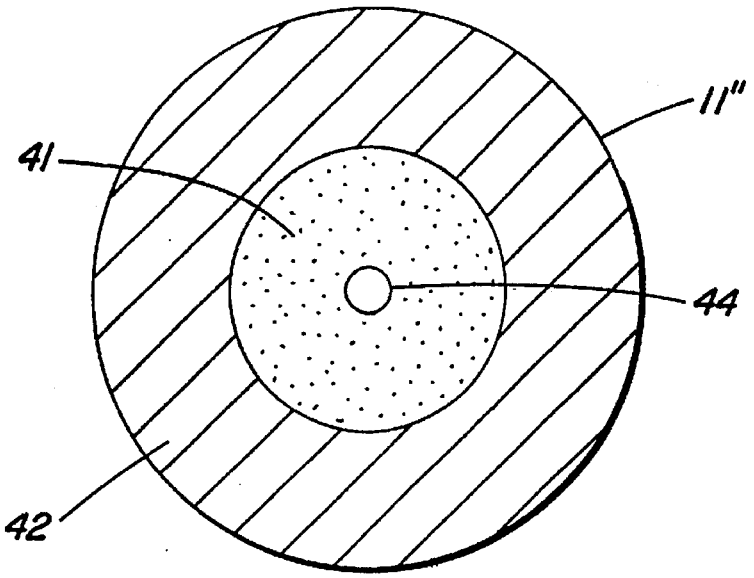
FIG. 4 is a cross-sectional view of a preferred gas generator for these pyrophoric flares.
Figure 5:
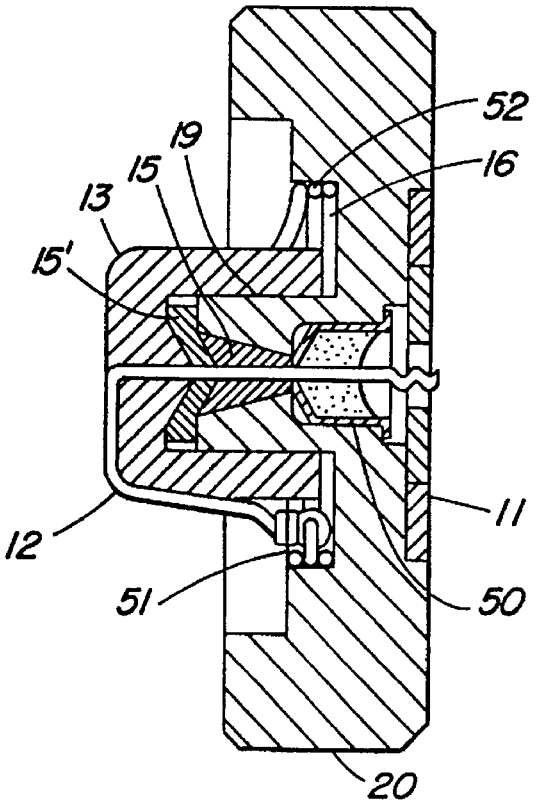
FIG. 5 is an enlarged cross-sectional view of the friction wire ignition mechanism for the pyrophoric flare shown in FIG. 1*a*.

The friction wire ignition mechanism and holder 20 are illustrated in more detail in the enlarged view of FIG. 5. A central bore extends through holder 20 to a cylindrical recess next to the gas generator 11, an igniter cup 50 being located in that recess with an open end of cup 50 facing gas generator 11. An opening in the bottom of igniter cup 50 is aligned with a central bore through holder 20. A friction wire 12 extends through the central bore and the opening in the bottom of cup 50 up to and through a central opening in the gas generating disc 11. The end of friction wire 12 extends just through the central opening 44 (see enlarged view of disc in FIG. 4) of disc 11 so that it is free standing in that central opening. The igniter cup 50 contains an energetic composition packed around the friction wire 12. That friction wire 12 is a metallic wire coated with red phosphorous, at least the end of the wire extending past cup 50 towards gas generator 11. When the friction wire is pulled out of cup 50 through the opening in its bottom, the friction sensitive red phosphorous on the wire will burn and ignite the energetic composition in cup 50 which then produces a flame and sufficient heat to initiate the gas generator 11. This will be explained in more detail later with respect to FIG. 1*b* which illustrates the operation of the ignition system as the flare is ejected from the launcher tube.

Figure 1B:
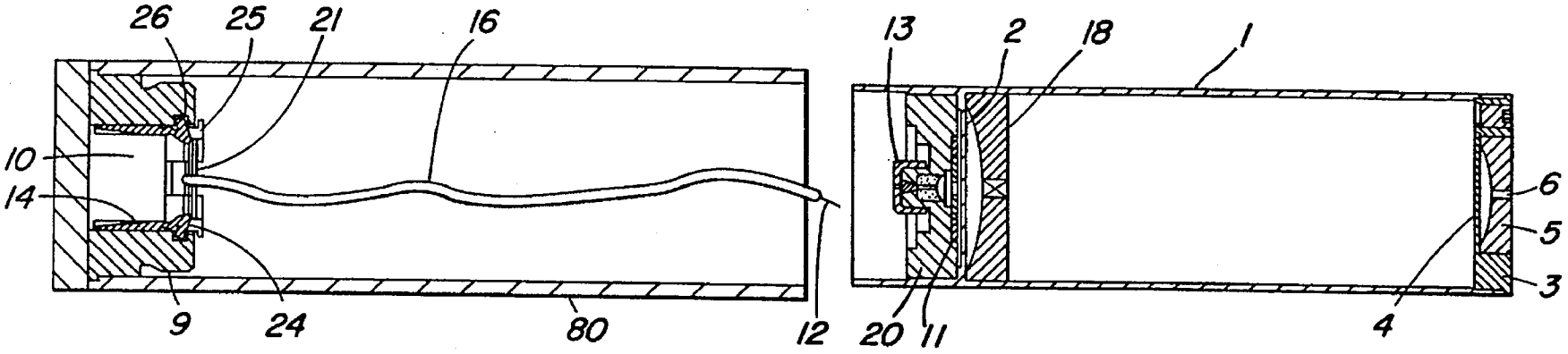
FIG. 1*b* is a cross-sectional view of the flare shown in FIG. 1*a* after being ejected from a launcher and activated by the firing cable.

Referring back to FIG. 5, the friction wire 12 extends towards the flare's base through the central bore of holder 20 and a central opening in a squeeze cap 13 that is cup shaped. The open end of cap 13 is connected to a cylindrical protrusion of holder 20 which extends outward from a central cylindrical recess 52 in holder 20. The recess 52 in holder 20 is in the opposite surface of holder 20 which holds gas generator 11. The wire 12 exits the central opening in squeeze cap 13 and extends in a groove along the end of cap 13 to its outer cylindrical surface with wire 12 then extending back along that surface towards recess 52 in holder 20 where wire 12 is connected by joint 51 to an arming cable 16. The arming cable 16 is coiled inside of recess 52 and has its other end connected to an anchoring pin 21 of the safety locking sleeve 14 as illustrated in FIG. 1*b* which shows the arming cable 16 after it is pulled out from recess 52 as the flare exits a launcher tube 80. That arming cable 16, also pulls friction wire 12 out of igniter cup 50, igniting the energetic composition packed in cup 50 as the flare is ejected from the launcher tube 80.

The central bore through holder 20, in which the friction wire 12 is normally positioned until the flare is activated, has a conical surface as shown in FIG. 5 which extends outward from the recess containing the igniter cup 50 to the end of a cylindrical protrusion 19, protrusion 19 extending outwardly from the recess 52 in holder 20. A conical septum 15, named Taper Septum, is located in and surrounds the friction wire 12 in the conical cavity formed by that conical surface. A second cylindrical septum 15', named Backup Septum, surrounding the friction wire 12 is squeezed against the exterior of the Taper Septum 15 by a conical protrusion extending from the inner bottom of squeeze cap 13, that protrusion compressing the two shaped septums 15, 15' into the conical cavity. The friction wire 12 extends through a central opening in those septums but the hole created by removal of the friction wire 12 during ignition of the flare is hermetically closed by the two squeezed septums 15 and 15'. These septums are designed to function together in a range of −54° C. to +71° C. and to hold pressures of over 1200 psi without leaking. Each of those septums have very specific sealing roles. The Taper Septum 15 is the main septum which is made of soft silicone to provide an efficient seal under very cold temperature. The cylindrical Backing Septum 15' compresses the Taper Septum and is made of harder silicone which provides an efficient seal at a higher temperature range.

Figure 3A:
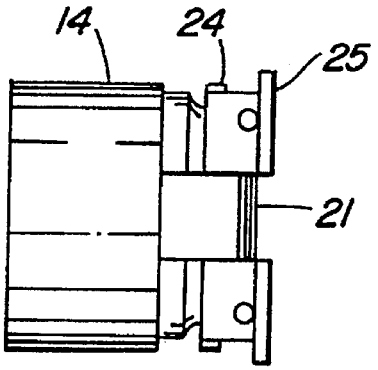
FIG. 3*a* is a side view of a safety locking sleeve shown in FIG. 1*a* and FIG. 3*b* is a top view of that sleeve.
Figure 3B:
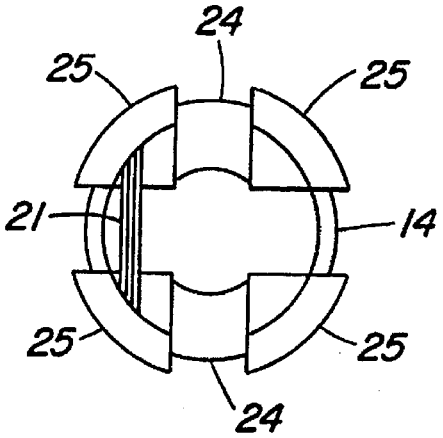
FIG. 3*c* is a cross-sectional view of the flare base and safety locking sleeve shown in FIG. 1*a* after being crimped by the impulse cartridge functioning.
FIG. 3*d* is a cross-sectional view of the flare base and safety locking sleeve shown in FIG. 1*a* that illustrates its functioning in the case of accidental separation.
Figure 3C:
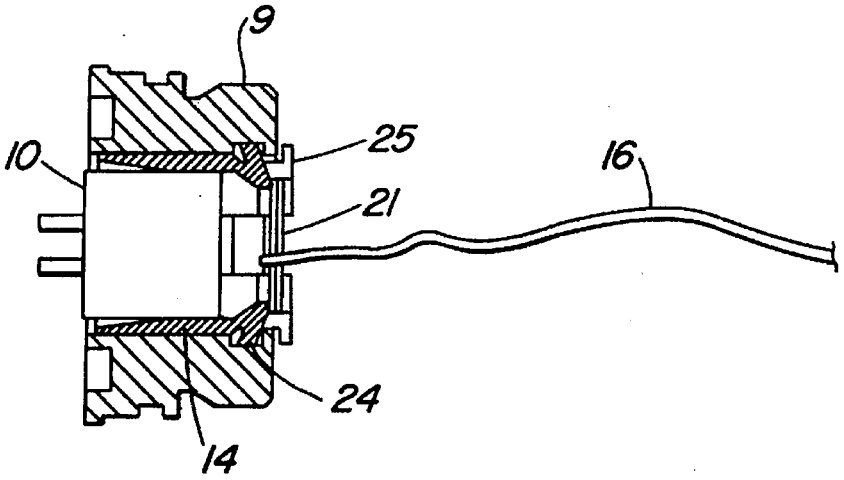

The functioning of the friction wire activated pyrophoric flare shown in FIG. 1*a* will now be described in more detail with reference to FIG. 1*b*. The flare base 9, to which the shell 1 is crimped at 8, contains a cylindrical opening in which a safety locking sleeve 14 is located, the sleeve 14 having flanges 25 that fit into a further cylindrical recess in the holder 20 adjacent the recess containing the arming cable 16. The flanges 25 are held in that recess be the inner end of base 9 which has an inner annular recess 26 adjacent that inner end. Two further inner flanges 24 of the locking sleeve 14 are located next to that annular recess 26 (see FIG. 1*a*) and are expandable, upon activation of impulse cartridge 10, so as to be shoved into recess 26 locking this safety locking sleeve 14 in position in the base (see FIG. 1*b*). The expandable flanges 24 are formed by cuts in the wall of the sleeve 14 and are located on opposite sides of sleeve 14 as shown in more detail in FIG. 3*a* and 3*b*. An anchoring pin 21 is connected to sleeve 14 between two of the flanges 25 as shown in FIG. 3*a* and 3*b* with one end of arming cable 16 being connected to pin 21 as illustrated in FIG. 3*c*. The main body of safety locking sleeve 14 fits into the cylindrical opening through base 9 with an impulse cartridge 10, a separate element, being located in the sleeve 14 in the cavity of base 9.

In order to activate this flare, the flare including the base 9 and impulse cartridge 10 are loaded into a tubular launcher 80 which is closed at one end, the flare's base 9 and impulse cartridge 10 resting against that closed end. It should be particularly noted that the arming cable 16 is attached at one end to friction wire 12 which extends through the igniter cap 50 and the other end of cable 16 is attached to pin 21 of the safety locking sleeve 14. To launch the flare, the impulse cartridge 10 located in the cavity of the flare base is first activated remotely. The shock wave and gas pressure generated by the impulse cartridge 10, crimps the flare safety locking sleeve in place by expanding flanges 24 into the annular recess 26 of base 9. FIG. 1*a* shows flanges 24 before being expanded whereas FIG. 1*b* shows the flanges 24 after being expanding into recess 26 to lock sleeve 14 in place. That shock wave and gas pressure also separate the flare from base 9 due to pressure generated on crimp 8, breaking it, and accelerating the flare out of the launcher tube. As this free-flying flare moves out of the tubular launcher 80, the arming cable 16 connected between the friction wire 12 and pin 21 of sleeve 14 unrolls. When the flare is completely out of the tubular launcher 80, the arming cable 16 reaches full length and pulls friction wire 12 out of igniter cap 50 igniting the energetic composition in cap 50 which, in turn, produces sufficient flame and heat to initiate gas generator 11. The hole created by removal of friction wire 12 is hermetically sealed by seals 15 and 15' so that pressure generated by gas generator 11 is initially entirely contained in the gas chamber space between the holder 20 and rupture disc 2. This is the position of the various elements illustrated in FIG. 1*b*. It should be noted the flare base 9, the safety locking sleeve 14, the impulse cartridge 10, the arming cable 16 and friction wire 12 remain in launcher 80.

The gas generator 11, once initiated in the free flying flare, will produce gases at a predetermined rate which increases the pressure inside the gas generator chamber between holder 20 and rupturing disc 2. That rupturing disc 2 will fail when its calibrated rupturing pressure is reached in that gas generator chamber. Once rupturing disc 2 fails, the pressurized gases will push against piston 18 which pressurizes the pyrophoric liquid in sealed shell 1 and this, in turn, will break the rupturing disc 4 that seals the other end of shell 1. This results in the pyrophoric liquid being pushed out through the calibrated nozzle 6 and ejected from the flare where it ignites spontaneously on contact with the air. The gas generator 11 and the rupturing disc 2 and 4 designs can be modified to set the distance from an aircraft at which the flare will start functioning and cause ignition of the pyrophoric liquid.

The gas generator 11 is designed to produce gases at a predetermined rate and is, together with the calibrated rupturing discs 2 and 4, responsible for the flare's performance. Energetic materials in the shape of solid pellets and/or thin layers of polymer bounded materials are preferred for the gas generator rather than granules or powders. The type of energetic materials used would be selected according to their functions of burning rate and ignitability. For a given mass, fast burning rate materials in gas generator 11 will give shorter flare duration and higher radiometric intensities.

In order to selectively control the gas production and ignitability of the gas generator, more than one energetic material having various shapes can be combined. A preferred configuration for a gas generator 11" is illustrated in FIG. 4 and is formed of two thin annular concentric discs 41 and 42 of propellant. The outer disc 42 is a slow burning propellant coated with an inhibitor to protect its surfaces from being ignited all at once. The inner disc 41 is a fast burning propellant coated with a primer to ensure an efficient ignition. Various pressure/time profiles can be obtained by varying the composition of propellants, their total mass, the thickness and diameters of each disc.

Figure 3D:
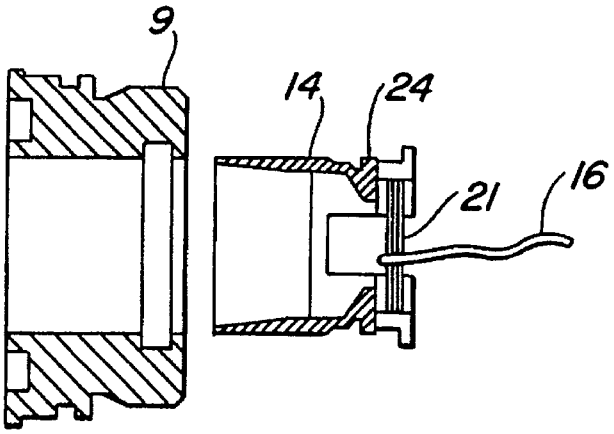

The safety locking sleeve 14 shown in FIGS. 1*a* and 1*b* acts as a safety device in the case of an accidental separation of the flare base 9 by rupture of crimp 8. This is best illustrated in FIGS. 3*a* to 3*d*. The flanges 25 at one end of sleeve 14 (see FIG. 3*b*) rest against the inner surface of a recess in holder 20 as shown in FIG. 1*a* and are held in that recess by the inner face of base 9 when it is fastened to the flare by crimp 8. Two inner flanges 24 of sleeve (see FIG. 3*b*), formed by cuts along the sleeve, are normally located next to a machined groove in the inner cavity of base 9 which forms the annular groove 26 shown in FIG. 1*a*. In a normal functioning of the impulse cartridge 10, the shock wave created will deform and push the two radial flanges 24 outward and into that machined groove 26 to lock the sleeve 14 and base 9 together as illustrated in FIG. 1*b* or 3*c*. If the crimp 8 that connects the flare to the flare base 9 fails accidentally during handling, however, then the safety locking sleeve 14 is free to slide out of base 9 as shown in FIG. 3*d*. This results in a safe separation of the flare from the flare base 9 without activation of the friction wire ignition mechanism. Once the sleeve 14 is separated from base 9, this effectively disarms the ignition mechanism formed by arming cable 16 and friction wire 12 since they will then not be near impulse cartridge 10.

The friction wire ignition mechanism with a safety locking sleeve as described above is considered to be very reliable and safe for operation. However, an alternative bore rider safety ignition mechanism according to a further embodiment of the invention is considered to be equally safe or even safer. The bore rider safety ignition according to this further embodiment of the invention is shown in FIGS. 2*a* and 2*b* with its operation being illustrated in FIGS. 2*c* and 2*d*.

Figure 2A:
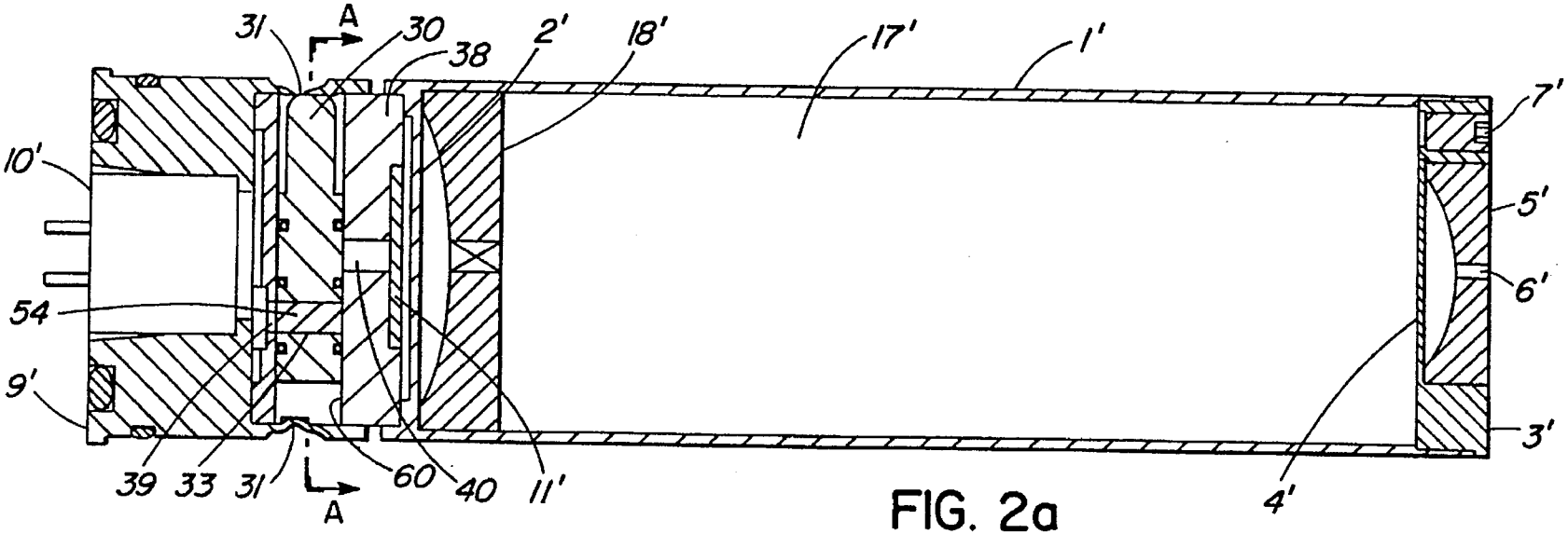
FIG. 2*a* is a cross-sectional view of a pyrophoric flare according to another embodiment of the invention with a bore rider safety ignition mechanism.

In FIG. 2*a* the tubular outer shell 1' and rupturing disc 2' along with cover 3' and rupturing disc 4' forming the container for pyrophoric liquid 17' are identical to those in FIG. 1*a* with the exception of the extension of outer shell 1 to the crimp 8. In FIG. 2*a*, the tubular outer shell 1' only has a short rearward extension that is attached to the holder 38 for the gas generator 11' and the bore rider ignition mechanism. The gas generator 11' is again located in a recess of holder 38 adjacent the rupturing disc 2' forming a gas generator chamber next to rupture disc 2'. The piston 18', nozzle cap 5', nozzle 6' and filling plug 7' are identical to those in FIG. 1*a*. However, the ignition mechanism for gas generator 11' located in holder 38 is designed and operates in very different manner from that shown in FIG. 1*a*. In FIG. 2*a*, the gas generator 11' is located in a circular recess on the inside surface of holder 38, a central opening 40 extending from the recess to a central bore 60 that extends through holder 38 along one diameter. A recess portion 61 extends along each side of bore 60 part way through holder 38 in a plane perpendicular to the central axis of the circular holder 38. Slots in the ends of the wall between the circular bore 60 and recess portions 61 extend part way down the recesses 61 as indicated by the slot edges 62 in FIG. 2*b*, the ends of those slots forming stops for protrusions 34 extending from each side of a bore rider 30 located in cylindrical bore 60. The ends of the protrusions 34 extend through the slots and into the recesses 61 with springs 35 being located in recesses 61 between the closed ends of the recesses and the protrusions 34. The spring 35 apply pressure against the protrusions 34 in a direction to press the protrusions away from the ends of the slots in the cylinder wall towards stops 37 located near the open end of the slots. However, a rounded end of an outer extension of bore rider 30 extends towards the outer end of those slots and is held in a position by a crimp 31 of a flange on flare base 9' to keep the protrusions 34 at the bottom of the slots against the pressure exerted by springs 35. The flange on the flare base 9' is crimped into both ends of central bore 60 to attach the base 9' to holder 38 and to the outer shell 1' as illustrated in FIG. 2A. The crimp 31, although not shown in the figures, extends entirely around holder in an encircling groove to firmly attach base 9' to holder 38 and to the flare.

Figure 2B:
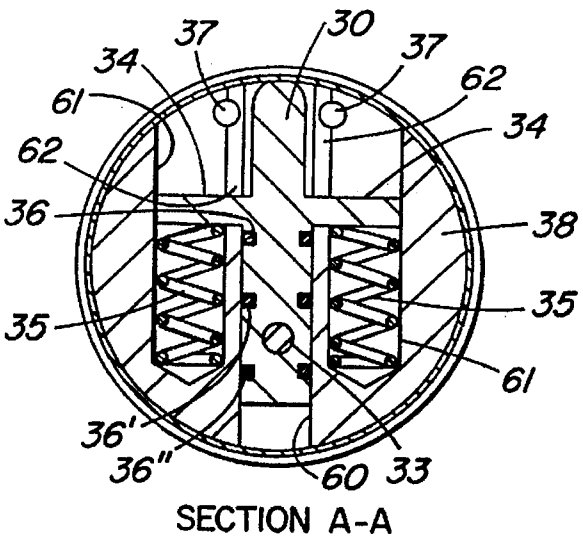
FIG. 2*b* is a cross-sectional view of Section A—A in FIG. 2*a*.
Figure 2C:
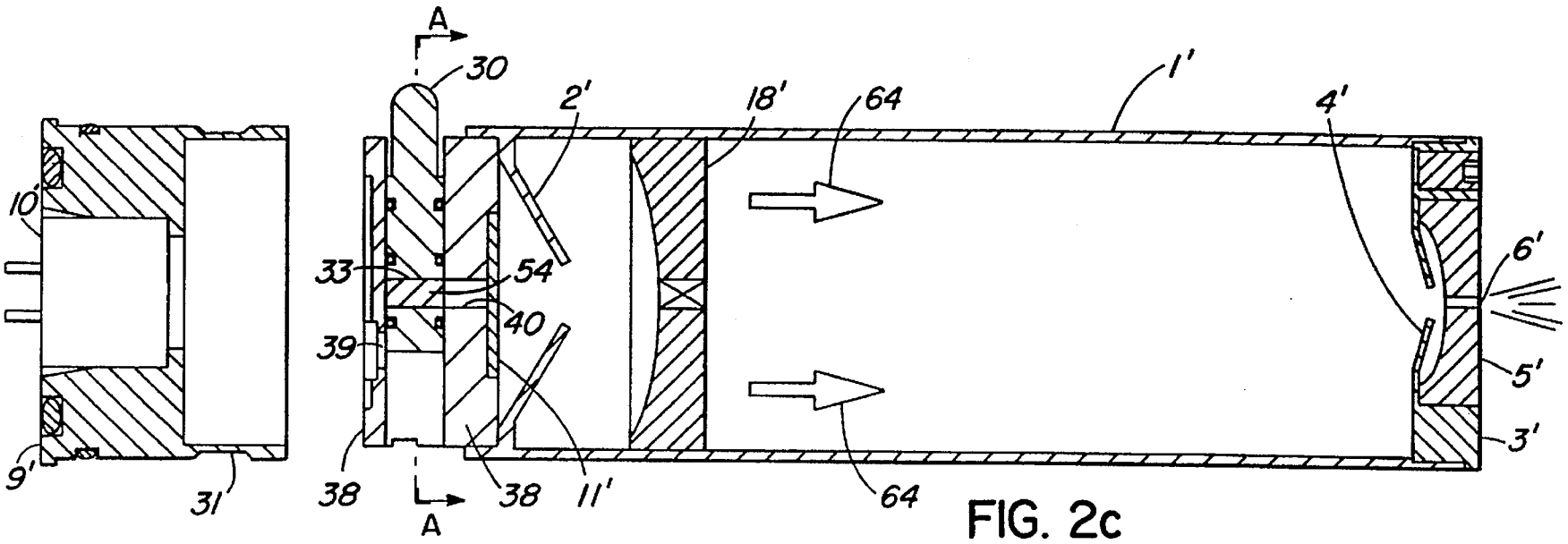
FIG. 2*c* is a cross-sectional view of the pyrophoric flare shown in FIG. 2*a* after ejection of the flare from a launcher.
Figure 2D:
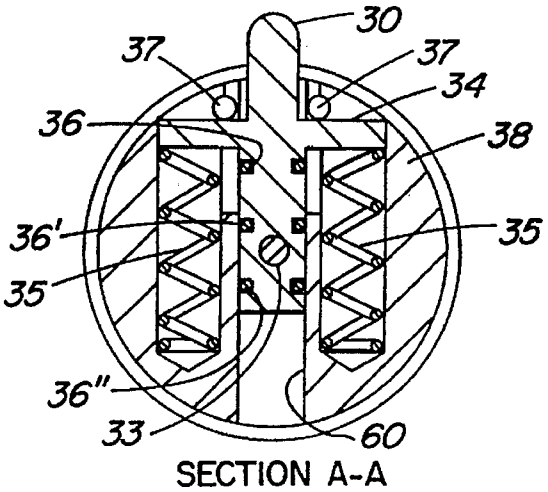
FIG. 2*d* is a cross-sectional view of Section A—A in FIG. 2*c*.

The lower portion of cylindrical bore rider 30 contains 3 silicone O-rings, two of which (36 and 36') are located on either side of the central opening 40 of holder 38 in the position of bore rider 30 shown in FIGS. 2*a* and 2*b*. An opening 33 extending through bore rider 30 contains an ignitable transfer pellet 54 and is located on the side of O-ring 36' away from opening 40, a further O-ring 36" being located on the other side of opening 33 away from O-ring 36'. Therefore, in the position shown in FIG. 2*a*, opening 33 and its transfer pellet are offset from but parallel to central opening 40 of holder 38. The opposite end of opening 33, away from opening 40, is aligned in FIG. 2*a* with an opening 39 that extends from central bore 60 to a cavity in the base 9', that cavity containing an impulse cartridge 10'when the flare is inserted into a launcher. It should be particularly noted that openings 39 and 40 are not aligned and are always separated from each other by one of the O-rings on cylindrical bore rider 30 inside of cylindrical bore 60. The opening 39 of holder 38 faces the cavity in flare base 9' containing the impulse cartridge 10' when the flare is in a launcher and is aligned with opening 33 containing the transfer composition pellet while the flare is in the launcher. When the impulse cartridge is initiated the gases produced transverse opening 39 to ignite the transfer composition pellet 54 in opening 33 through the bore rider 30. However, in this initial position the O-ring 36' will ensure that the gases produced by the initiated impulse cartridge 10' and burning transfer composition pellet in opening 33 will not reach the central opening 40 that leads to the gas generator 11'. The gases and shock wave produced by the impulse cartridge 10' will, however, also break the flare base crimp 31 and accelerate the flare out of a launcher tube similar to the tubular launcher 80 shown in FIG. 1B. The rounded end of bore rider 30 will move outward slightly in cylindrical bore 60 under the action of springs 35 once the flange of flare base 9' and crimp 31 are separated from the main body of the flare. The rounded tip of bore rider 30 will then ride against the wall of the tubular launcher until the flare is clear of the launcher. This will still keep the opening 33 with the burning pellet away from opening 40 and prevent the pellet from igniting the gas generator 11'. Once the flare is entirely clear of the launcher, however, the two springs 35 will push the bore rider 30 outwards until the protrusions 34 of the bore rider 30 rests against stops 37 adjacent one end of bore 60. Upon displacement of the bore rider 30 due to spring 35 once the flare reaches free flight, the central opening 40 will become aligned with the still burning transfer composition pellet in the bore rider opening 33 as shown in FIG. 2*c*. That burning pellet will then ignite the gas generator 11' and the flare will operate in the same manner as described with respect to FIG. 1*b*. That is the pressures generated by gas generator 11' will increase to rupture rupturing disc 2', pushing piston 18' in the direction of arrows 64 which increases pressure against rupturing disc 4' until it ruptures causing the pyrophoric liquid to be ejected through calibrated nozzle 6'. This operation is illustrated in FIGS. 2*c* and 2*d*. It should be particularly noted that the O-rings 36' and 36" during this operation are located on either side of opening 40 and will prevent gases generated by generator 11' from escaping into bore 60. Therefore, all the gases generated by 11' will be directed to increasing the pressures in tubular shell 1' and pushing piston 18' towards the nozzle outlet 6'.

Two distinct events must occur within a fraction of a second for the bore rider activated pyrophoric illustrated in FIGS. 2*a* and 2*d* to function. First, the transfer composition 54 in the opening 33 of the bore rider 30 must be ignited by an external source of heat such as the impulse cartridge 10'. Once the transfer composition is ignited, the flare base 9' must separate from the flare and the flare must exit the launcher to allow for the bore rider 30 displacement by springs 35 and the initiation of the gas generator 11' by the burning transfer composition. This second event must occur within the burning duration of the transfer composition, i.e. about 0.25 sec., in order for the flare to function properly. If, by any means, the flare should remain stuck in the launcher, the ignition gases from the burning transfer composition pellet would never reach the gas generator and the flare would not function. This flare would then be non-serviceable and safe to handle, i.e. pull out of the launcher, since no ignition means would any longer exist. A further advantage of the bore rider safety ignition mechanism is that it is considered to be a no stored energy concept, i.e. the flare by itself cannot function without an external stimuli. The impulse cartridge is required for this flare to function and that impulse cartridge is only present when the flare is loaded into a launcher.

Various modifications may be made to the preferred embodiments without departing from the spirit and scope of the invention as defined in the appended claims.

The embodiments of the invention in which an exclusive property or privilege is claimed are defined as follows:

1. A decoy flare for infrared (IR) seeking missiles comprising a tubular outer shell with a first rupturing disc adjacent to and closing a rear end of the outer shell and a cover member with a central second rupturing disc sealing another end of the outer shell, a nozzle cap with a nozzle being attached to the cover member adjacent an outer surface of the second rupturing disc, the nozzle being located in front of that outer surface, the outer shell and cover member forming a container for a pyrophoric liquid with a movable closure in the tubular outer shell being initially located adjacent the first rupturing disc between pyrophoric liquid in the container and the first rupturing disc; the flare having a first holder for a gas generating means with that holder being connected in sealed relationship to said container in a position to locate the gas generating means near an outer surface of the first rupturing disc and form a gas generating chamber between the first rupturing disc and said first holder, the first holder being provided with an initiating means to activate said gas generating means and a sealing means to prevent gases generated by the gas generating means from exiting via said first holder when the initiating means is activated; the flare having a base portion, a means for attaching the base portion to the tubular outer shell and to separate the base from the outer shell when the flare is activated, the base portion forming a further holder for a means to activate said initiating means and then the gas generating means wherein said movable closure is movable towards said nozzle under pressure generated by the gas generating means upon rupture of the first rupturing disc under gas pressure generated in said chamber and movement of the closure transfers the pressure to said second rupturing disc to rupture the second rupturing disc and eject pyrophoric liquid through said nozzle.

2. A decoy flare as defined in claim 1, wherein the movable closure is a piston.

3. A decoy flare as defined in claim 2, wherein the gas generating means is a disc of energetic materials attached to one surface of said first holder, the initiating means including an igniter cup containing an energetic composition located in a recess in said one surface with an open end of said cup facing said disc, a friction wire extending through said cup to an opening in the cup's bottom which opening is aligned with a central bore through said first holder, the friction wire extending through said bore and an aligned opening in a cup shaped squeeze cap that is attached to the first holder's surface that is opposite said one surface, the central bore having a conical surface extending outward from said igniter cup forming a conical cavity facing said squeeze cap, which cap contains a conical protrusion extending from its bottom towards the conical cavity, said sealing means comprising a tapered seal surrounding the friction wire in said conical cavity and compressed into the conical cavity by said conical protrusion, an end of the friction wire exiting the squeeze cap being connected to one end of an elongated arming cable positioned in the flare in a compacted state, the other end of the arming cable being connected to a pin of a safety locking sleeve positioned in the base portion whereby the arming cable is pulled from said compacted state by said pin when the flare is ejected from a launcher which then pulls said friction wire from the igniter cup upon the arming cable reaching its full length, the removal of said friction wire igniting said energetic composition.

4. A decoy flare as defined in claim 3, wherein an end of the friction wire adjacent said disc is coated with friction sensitive ignitable material.

5. A decoy flare as defined in claim 3, wherein the safety locking sleeve is slidably located in an opening extending through the base portion with that opening containing at least one recess in its inner surface and the sleeve having at least one expandable flange located adjacent said at least one recess which is expandable into that recess to anchor the sleeve to the base, the means to activate said initiating means comprising an impulse cartridge located in said sleeve which produces gases and pressures when activated to expand said at least one expandable flange into an associated recess locking said sleeve to the base portion, those gases and pressures created by the impulse cartridge separating the base portion from the tubular outer shell.

6. A decoy flare as defined in claim 5, wherein the means for attaching the base portion to the tubular outer shell is a tubular flange of the outer shell which extends rearwardly of said first holder, the tubular flange being crimped into a groove around an outer surface of the base portion.

7. A decoy flare as defined in claim 3, wherein a cylindrical seal surrounds the friction wire between the tapered seal and the conical protrusion, the conical protrusion compressing both seals in the direction of the conical cavity.

8. A decoy flare as defined in claim 7, wherein the tapered seal is formed of soft silicone and the cylindrical seal is formed of harder silicone.

9. A decoy flare as defined in claim 1, wherein the tubular outer shell and first rupturing disc are an integral single element, the cover member and second rupturing disc being a second integral single element.

10. A decoy flare as defined in claim 2, wherein the gas generating means is a disc of energetic materials attached to one surface of said first holder, the initiating means including a cylindrical bore rider slidable in a cylindrical bore which extends through the first holder along its diameter, a first opening in said first holder extending from said disc to said bore and a second opening in said first holder extending from said bore to an opening extending through said base portion in which an impulse cartridge can be located when the flare is in a launch tube, the first and second openings extend in opposite directions from said bore and are offset from each other along the axis of the bore; the first holder having at least one recess portion parallel and adjacent to said bore with a wall between said bore and that recess portion extending outward from a bottom of the recess portion to an intermediate depth of that recess portion, a protrusion on the bore rider extending into that recess portion between the intermediate depth and an open end of the recess portion, a portion of the wall at said intermediate depth forming a first stop for said protrusion, a further stop for the protrusion being located at an open end of that recess portion, a spring means being located between the bottom of that recess and the protrusion which presses the bore rider outward towards said further stop; the bore rider containing an ignitable-transfer composition pellet in an opening which extends through the bore rider parallel to the first and second opening with that opening being aligned with said first opening when said protrusion is at said further stop and aligned with said second opening when said protrusion is at said first stop, O-rings encircling the bore rider on each side of the opening through the bore rider to provide a gas seal with the bore for gases generated by an ignited transfer composition pellet and to prevent those gases from entering the first opening when the protrusion of the bore rider is at said first stop, the O-rings providing said sealing means by creating a gas seal for gas generated by said disc from exiting through said bore when the protrusion is at said further stop and said disc is activated; the bore rider further having an extension extending outward from said protrusion for a length that will locate said protrusion at said first stop when a tip of that extension is located adjacent an end of the bore and the base portion has an outer flange that is crimped to said first holder at ends of the bore to hold said extension in a position where the protrusion is located at said first stop; wherein an opening in the base portion for holding an impulse cartridge is positioned such, that when an impulse cartridge in the base portion is activated, that impulse cartridge will break the crimp to separate the base from the first holder and ignite the transfer composition pellet through said second opening, that separation allowing the flare to be pushed out of a launch tube by the impulse cartridge and the bore rider to be pushed outward by said spring means towards said further stop once the flare is clear of a launch tube, that further stop aligning the burning pellet with the first opening in order to activate the gas generating means.

11. A decoy flare as defined in claim 10, wherein the first holder has two recess portions parallel and adjacent to said bore, the recess portions being located on opposite sides of said bore with said wall between the bore and recess portions extending outward from said intermediate depth to an open end of the recess portions, two slots in said wall extending inward from an outer edge of the wall to said intermediate depth with each slot opening into one of the recess portions, protrusions on opposite sides of the bore rider extending through said slots into an associated recess portion wherein bottoms of the slots form said first stop for each of said protrusions and a spring means is located between a bottom of each recess portion and an associated protrusion, the spring means pressing the bore rider outward towards further stops for said protrusions, which further stops are located at open ends of the recess portions.

12. A decoy flare as defined in claim 2, wherein the disc comprises two thin concentric discs of propellent with an outer disc being formed of a slow burning propellant coated with an inhibiter and an inner disc being formed of a fast burning propellant coated with a primer.

13. A decoy flare as defined in claim 3, wherein the disc comprises two thin concentric discs of propellent with an outer disc being formed of a slow burning propellant coated with an inhibiter and an inner disc being formed of a fast burning propellant coated with a primer.

14. A decoy flare as defined in claim 10, wherein the disc comprises two thin concentric discs of propellent with an outer disc being formed of a slow burning propellant coated with an inhibiter and an inner disc being formed of a fast burning propellant coated with a primer.

15. A decoy flare as defined in claim 2, wherein the tubular outer shell and first rupturing disc are an integral single element, the cover member and second rupturing disc being a second integral single element.

16. A decoy flare as defined in claim 10, wherein the tubular outer shell and first rupturing disc are an integral single element, the cover member and second rupturing disc being a second integral single element.

17. A decoy flare as defined in claim 5, wherein a cylindrical seal surrounds the friction wire between the tapered seal and the conical protrusion, the conical protrusion compressing both seals in the direction of the conical cavity.

18. A decoy flare as defined in claim 17, wherein the tapered seal is formed of soft silicone and the cylindrical seal is formed of harder silicone.

19. A decoy flare as defined in claim 6, wherein a cylindrical seal surrounds the friction wire between the tapered seal and the conical protrusion, the conical protrusion compressing both seals in the direction of the conical cavity.

20. A decoy flare as defined in claim 19, wherein the tapered seal is formed of soft silicone and the cylindrical seal is formed of harder silicone.

* * * * *